US011577152B2

(12) United States Patent
Crenshaw et al.

(10) Patent No.: US 11,577,152 B2
(45) Date of Patent: Feb. 14, 2023

(54) ON TRACK AN IMPROVED SHOOT THE MOON GAME

(71) Applicants: Donald R. Crenshaw, Santequin, UT (US); Joe Fox, Spanish Fork, UT (US)

(72) Inventors: Donald R. Crenshaw, Santequin, UT (US); Joe Fox, Spanish Fork, UT (US)

( * ) Notice: Subject to any disclaimer, the term of this patent is extended or adjusted under 35 U.S.C. 154(b) by 360 days.

(21) Appl. No.: 16/934,034

(22) Filed: Jul. 21, 2020

(65) Prior Publication Data

US 2022/0023747 A1 Jan. 27, 2022

(51) Int. Cl.
*A63F 3/00* (2006.01)

(52) U.S. Cl.
CPC ..... *A63F 3/00028* (2013.01); *A63F 2003/00463* (2013.01); *A63F 2003/00899* (2013.01)

(58) Field of Classification Search
CPC ..... A63F 3/00028; A63F 2003/00463; A63F 2003/008998
See application file for complete search history.

(56) References Cited

U.S. PATENT DOCUMENTS 570,105 A * 10/1896 Ryan et al. ..... A63F 7/388 273/123 R
1,595,071 A * 8/1926 Carlson ..... A63F 7/388 273/110
3,912,272 A * 10/1975 Hicks ..... A63F 7/0017 273/129 R
3,985,360 A * 10/1976 Meyer ..... A63F 7/388 273/120 R
4,236,716 A * 12/1980 Douglas, Jr. ..... A63F 7/388 273/357
4,822,045 A * 4/1989 Shoemaker, Jr. ..... A63F 7/388 273/121 E
4,877,245 A * 10/1989 Haynes ..... A63F 7/388 273/110

FOREIGN PATENT DOCUMENTS

GB 2126115 A * 3/1984 ..... A63F 7/0058
GB 2479575 A * 10/2011 ..... A63D 15/045

* cited by examiner

*Primary Examiner* — Joshua T Kennedy

(57) ABSTRACT

A game board comprising a tapered playing field with walls rising from a perimeter thereof. The board comprises open receptacles arranged in a pattern or randomly on the playing field. A triangular pattern extends from an apex adjacent to a first wall to a base adjacent to a second wall. Each of the receptacles comprise a depth and a diameter sufficient to capture a ball used in the game. A movable track comprising a pair of rods comprising first and second ends is disposed above the field. The first ends are attached to a pivot disposed on the first wall and the second ends are inserted through an elongate opening in the second wall. The track is inclined from the pivot ends. A ball placed on the track near the pivot ends is urged to travel uphill along the track and dropped into a receptacle by manipulating the rods.

20 Claims, 9 Drawing Sheets

D
A
a
a
a

ON TRACK AN IMPROVED SHOOT THE MOON GAME

FIELD OF INVENTION

A game of skill using the manipulation of an inclined duel-rod track to propel a ball along the track and drop the ball into a target receptacle. Each of the receptacles are assigned a number or letter such that certain quantities may be achieved, or certain words produced using multiple balls.

BACKGROUND OF THE INVENTION

It is said that the game "Shoot the Moon" dates back to the 1940s. However, the originator of the game may have been Rufus E. Bean, as disclosed in U.S. Pat. No. 145,385, issued Dec. 9, 1873. Over the years, the game has been produced and marketed without significant alteration by different companies under such names as "Shoot the Moon," "Hit the Spot," "Space Shot," "Anti-gravity Game," "Space Force," "Frustration," and "Shoot-a-Shot." A search of the internet reveals additional variations of the game without attribution. The following U.S. patents have also disclosed additional variations of the game: U.S. Pat. No. 570,105, 1896, to Ryan et al., entitled Game Apparatus; U.S. Pat. No. 699,490, 1902, to Buxton et al., entitled Toy or Game Apparatus; U.S. Pat. No. 1,595,071, 1926, to Carlson et al., entitled Game; U.S. Pat. No. 3,985,360, 1976, to Meyer, entitled Game Apparatus; U.S. Pat. No. 4,669,727, 1987, to David, entitled Double-Bar Riding Wheel and Method of Using Same; U.S. Pat. No. 4,746,121, 1988, to David, entitled Three-Bar and Ball Game apparatus and Method of Using Same, and U.S. Pat. No. 4,822,045, 1989, to Shoemaker, Jr. entitled Rolling Ball Game.

Basically, the game consists of placing a ball on two adjacent rods, forming a dual-rod track, that are hinged at one end and urging the ball to travel on the track by opening and closing the distance between the two rods. In some cases, the rods are inclined so that the ball appears to roll up hill defying gravity. Most of time the dual-rod track is disposed over a narrow field comprising a single column of receptacles denominated as some of the planets in earth's solar system. There is disclosed on the Pinterest website a child's game variation depicting a narrow column of planets offset from one another. (See: Https://www.pinterest.com/pin/6403624453600951) The goal is to land the ball in the planet or other designated receptacle having the highest points, usually the receptacle furthest along the track from the hinged end.

At least one scientific paper has been published describing the physical dynamics of the game. Xu P. 2011: Dynamics and Control of the Table-Top Game Shoot the Moon. [partial dissertation]. Clemson University.

Although the game requires skill in mastering the physical dynamics of urging the ball along the inclined dual-rod track, once the technique is mastered, a player may be able to move the ball consistently with little effort. The sole object of every iteration of the game is to move the ball all the way along the track and score the highest points available from the limited number of receptacles—the number of receptacles being limited by the number of planets in the Earth's solar system. Once the game is mastered, interest in the game often wanes and the game is set aside in favor of more challenging games.

Therefore, what is needed is an iteration of the game that presents a wider variety of challenges so that it is not enough just to be able to cause the ball to travel the length of the dual-rod track and drop the ball into a desired planet receptacle. By increasing the difficulty of the game and broadening the scope of the ways the game is played, interest in the game may be renewed and the future of the game for generations to come may be assured.

SUMMARY OF THE INVENTION

This invention presents a game of skill in which a one or more balls are dropped from an over-playing-field track into selected receptacles below. The track being comprised of two rods attached to a pivot or hinge at one end and operable by increasing or decreasing the distance between the rods by a player at the other ends of the rods. The game may be played as a lap game or scaled up to be played standing or sitting at a suitable table or adapted to be played in a large format outdoors as a lawn game. The game includes a game board that may be enclosed by perimeter walls. The game board may comprise a playing field tapered outward and downward from the center of the field to the respective perimeter walls. The walls rise from the perimeter of the game board. Opposing walls may be of varying heights. The walls may also include openings required to play the game.

The playing field within the enclosure may comprise multiple rows and columns of open receptacles arranged in a triangular pattern extending the length of the enclosure and centered on the playing field. The receptacles may be lined up in rows and columns or the receptacles may be scattered around or randomly arranged within the triangular pattern. Each receptacle is assigned a number or letter to be used in scoring the game. Numbers may be used to determine which player scores the most points or is first to reach a desired quantity. Letters may be used to spell words or messages used in scoring the game. The receptacles are usually round but could be of a non-round shape having a depth sufficient to capture or hold a game ball dropped or deposited from the overhead dual-rod track into the receptacle. The receptacles may have varying diameters and depths to accommodate the various sizes of balls that may be used in the game. Game balls may fit completely into the receptacles or may only partially fit into the receptacles. In some instances, the game ball may be balanced on the receptacle such that only a small portion of its circumference engages the receptacle. The less likely the game ball may be captured in or on the receptacle, the greater the value attributable to that receptacle in scoring the game.

The game may also have ball holding cups having diameters and depths suitable for capturing playing balls. The cups may be placed in some or all the receptacles. As with the receptacles, the playing ball may fit entirely or partially within one or more cups. The cups may be reversible so that they can be turned upside down within the receptacles. When a cup is reversed, the receptacle is blocked or closed off so that a ball cannot be deposited or dropped into the closed receptacle. In this manner, the difficulty of the game may be increased by decreasing the number of receptacles available to achieve a desired quantity or word. By blocking or closing off receptacles and cups, the playing field may be programed with easier or more difficult patterns of available receptacles. Other means may be used to block the receptacles and thereby program the field. Coins, disks, or caps may be used to cover the cups and receptacles. A strategy of the game may be to block all the receptacles representing vowels, or to close off receptacles representing numerals essential for reaching a selected amount—for example by closing off all the numeral 3s, a player could be precluded from a total score including the numeral 3 or a multiple of 3. In playing the game each player may be allowed to block or close off a certain number of receptacles or cups. Likewise, certain letters may be blocked to preclude the formation of words and phrases.

Although arranging the receptacles in a triangular pattern may be preferred on the playing field, other patterns may be selected by the players. Additionally, the playing field may not be constrained by any pattern. The receptacles may be spaced apart in rows, columns or randomly covering the entire playing field. Spacing between the receptacles should be sufficient to accommodate the various sizes of balls used in the game. However, it may add to the difficulty to arrange some receptacles so close to one another that only a certain size ball may be captured in the respective receptacle or cup.

When the playing field exhibits a triangular pattern of receptacles, the pattern may extend from a triangular apex adjacent to a first wall to a triangular base adjacent to a second wall. The receptacles on the playing field may be spaced apart at least the diameter of the smallest ball used in the game. Spacing between the receptacles should be sufficient to accommodate the various sizes of balls used in the game. However, spacing between the receptacles may vary such that some balls may not be placed adjacent one another.

The playing field may comprise a punch-out board. The punch-out board may be exchanged for the triangular playing field, or it may overlay the playing field with any configuration of playing fields. A player may punch out any number of receptacles in any number or pattern desired by the player. In this manner the game board becomes programmable by one or more players adding variety and difficulty to the game beyond the previous iterations of the game. Each of the punch out receptacles may be given a numerical value or letter that could be used in scoring the game.

The game balls are distributed over the playing field by means of a laterally movable dual-rod track comprising a pair of rods comprising first and second ends disposed above the playing field so as not to interfere with the balls below. The rods may be composed of a metal such as steel, stainless steel, copper, brass, aluminum, or combination thereof. The rods may be solid or tubular. The rods may be wooden or plastic or some other material such as glass, fiberglass, Teflon, rubber, nylon, rock, bone, ivory, bamboo, or reed. The surface finish on the rods may be smooth, polished, rough, or interrupted.

The rods comprise first and second ends. The first ends are attached to a pivot disposed on or in relation to the first wall of the enclosure and the second ends are mounted on a surface of the second wall. The rods may be inserted through an elongate opening in the second wall to control the movement of the dual-rod track. The tack may be inclined from the pivot end to the second wall by providing that the second wall is higher than the pivot or by providing that the elongate opening in the second wall is higher than the pivot. The playing field may be tilted to achieve the desired inclination of the dual-rod track or to bias loose balls toward one side or the other of the playing field. Also, the track's inclination may be controlled by providing adjustable elevation blocks or jacks attached to the enclosure proximate the second wall. Screw or lever jacks for lifting the second wall end of the playing field may be useful in providing the desired inclination for the dual-rod track.

The game is played when a ball is placed on the track at the pivot end and the rods are manipulated by increasing and decreasing the distance between the rods to move the ball uphill along the track. The track is oriented so that it does not interfere with balls previously dropped onto the playing field. The track may be swung laterally to direct the track over a desired receptacle on the playing field. Once the ball is moved to a desired location, the distance between the rods is increased to allow the ball to fall into the desired receptacle. This process is repeated until the desired numerical score is reached or a word or phrase is spelled out. A player's turn may be timed or limited by the number attempts to reach a desired quantity or spell a word or phrase, or by the number balls assigned to the player are captured on the playing field. Opposing players may not know a player's desired numerical total or word, or combination thereof.

DETAILED DESCRIPTION OF THE INVENTION

The present invention is further disclosed with reference to the various drawing figures submitted in connection with this invention.

Figure 1:
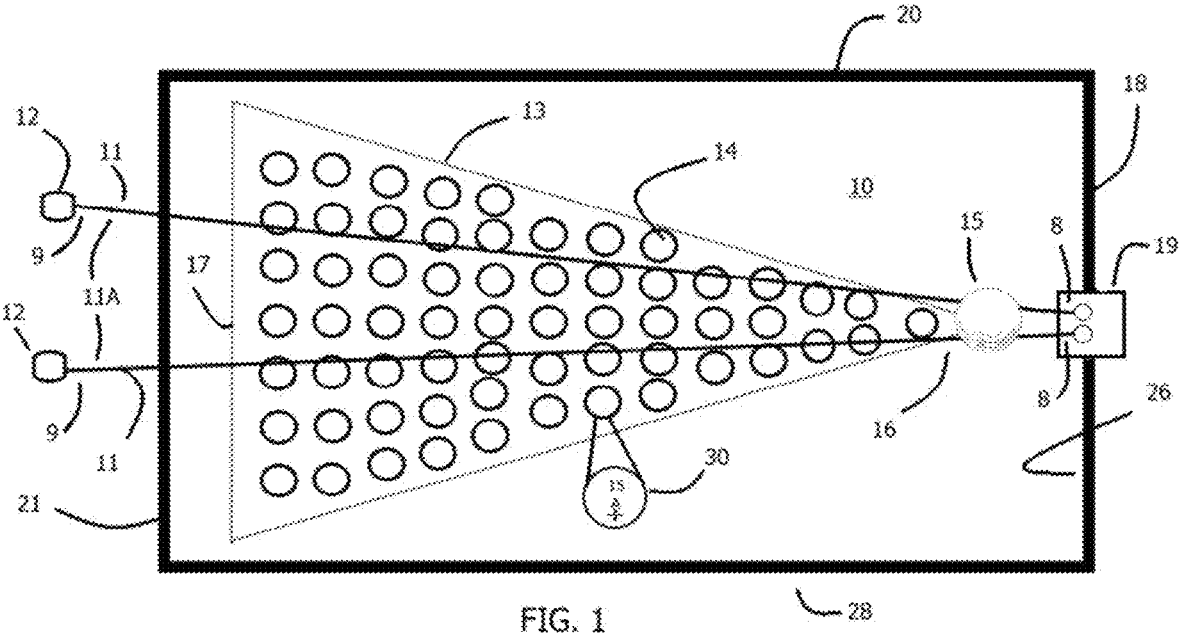
FIG. 1 is a top view diagram of a game board of the present invention.
Figure 3:
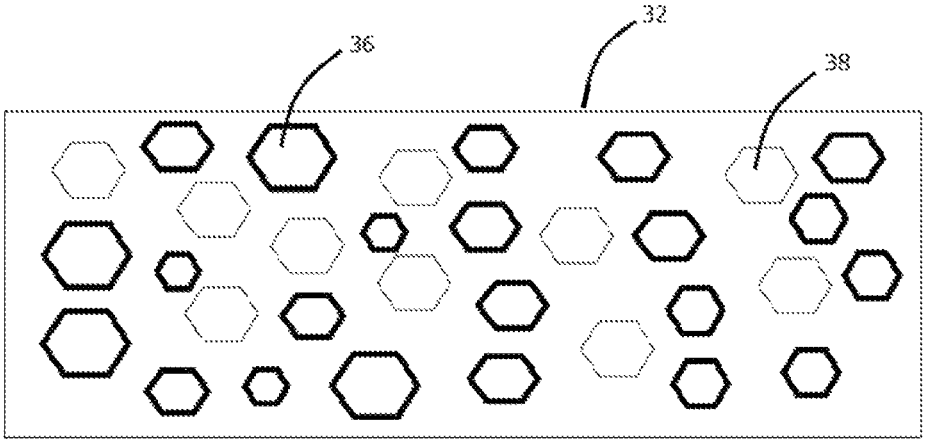
FIG. 3 is a top view diagram of a substitute playing field having punch-out receptacles of the present invention.

FIG. 1 is a top surface diagram of a game board (10) of the present invention. The game board (10) comprises perimeter walls (18, 20, 21, and 28) rising from the surface of the game board (10) and enclosing a triangular shaped playing field (13). A top surface of game board (10) may be tapered (45) from the middle thereof downward toward perimeter walls (20, 28). The playing field (13) comprises numerous receptacles (14) spaced apart and arranged in columns and rows or randomly across the playing field (13). As shown in FIG. 1, the game board (10) comprises a rectangular shape, but the game board (10) may also comprise other geometric shapes including but not limited to a square, triangle, or other quadrilateral configurations. The game board (10) may also be circular in shape. The playing field (13) may be interchangeable with different shapes that may fit within the perimeter walls (18, 20, 21, 28). The game board (10) may comprise a punch-out board (32) as shown in FIG. 3. that may allow a player to punch out selected receptacles (38) for a personalized playing field. The punch-out board (32) may overlay all or a part of game board (10) as a playing field, or the punch-out board (32) may be substituted for the game board (10).

Figure 2:
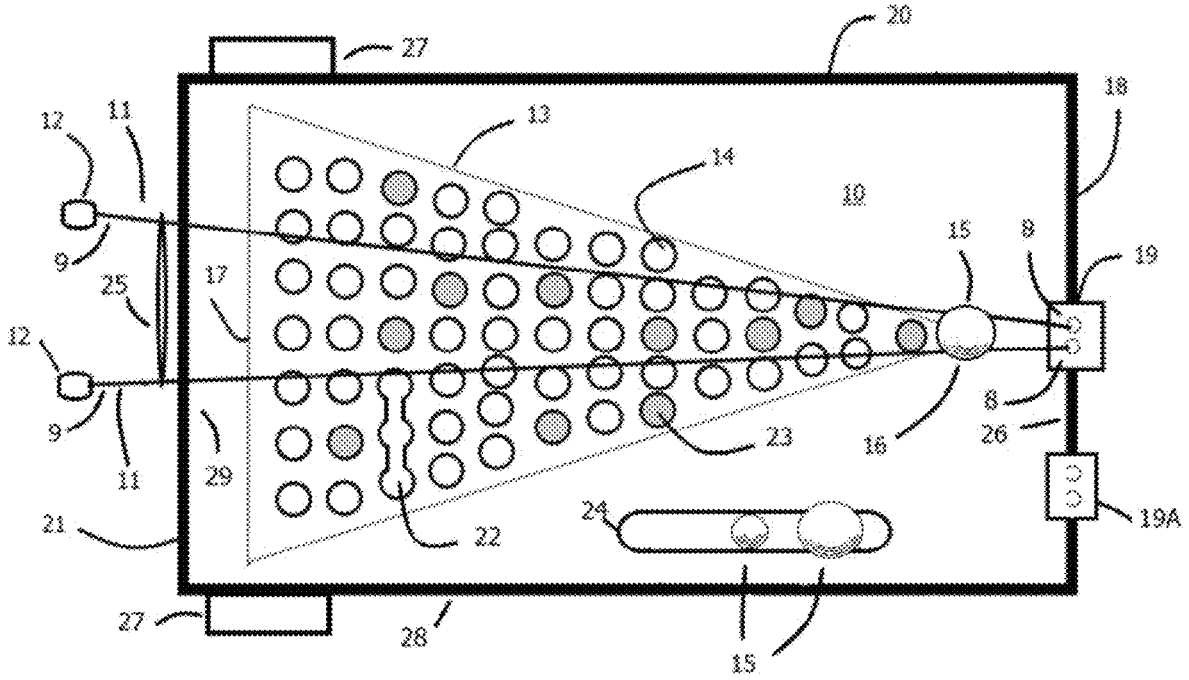
FIG. 2 is a top view diagram of a game board of the present invention.

A pivot or hinge (19), that may also serve as a ball stop preventing ball (15) from rolling off dual-rod track (11A), may be mounted on first wall (18) adjacent an apex (16) of the triangular playing field (13). The location of the pivot (19) may vary by providing more than one pivot (19A) being mounted on first wall (16) as shown in FIG. 2. When the playing field (13) is a triangular shape, the triangular apex (16) may be positioned adjacent wall (18) on which one or more pivots (19A) may be disposed. The pivots (19, 19A) may be disposed inside an opening on the inside surface (26) of first wall (18).

A pair of rods (11) comprising first ends (8) and second ends (9) comprise a dual-rod track (11A). First ends (8) may be inserted into pivot (19) located on first wall (18) and the rods (11) being extended across and above the playing field (13) and second ends (9) extending over or through second wall (21) adjacent a base (17) of the triangular playing field (13). The pair of rods (11) may rotate and swing side to side together or individually in pivot (19). The pair of rods (11) may be inclined from a lower position on first wall (18) to a higher position on or through second wall (22) adjacent the base (17) of the triangular playing field (13). The rods (11) may be inserted through an elongate opening in second wall (21) and extended beyond wall (21) and comprise handles (12) attached to second ends (9) to aid in manipulation of the rods (11). The rods (11) may be solid or hollow, and composed of wood or metal, bone, ivory, glass, fiberglass, plastic, Teflon, or another carbon-based compound. The track (11A) may be disposed at a sufficient height above the playing field (13) to allow the track (11A) to pass freely over one or more balls (15) deposited into the receptacles (14) on the playing field (13).

In playing the game, a ball (15) is placed onto track (11A) near the pivot (19). Using the handles (12), the player manipulates the rods (11) to cause the ball (15) to travel uphill toward the base (17) by increasing and decreasing the distance between the respective rods (11). The player may swing the track (11) side to side or laterally to direct the ball to a desired receptacle (14) on the playing field (13). In playing the game, a player may be assigned a certain number of balls (15), or tries, to reach a desired score. Scoring may be in terms of a numerical sum or a word or phrase. Each of the receptacles (14) may have an assigned numerical value as shown in exploded view (30) or one or more alphabetical letters (30) that may be used to spell out words or phrases. Some receptacles may have one or more symbols, such as mathematical symbols or terms, or an emoji assigned to them that may be used in playing and scoring the game. Players may be assigned a time limit or a certain number of tries or balls to reach a designated score.

The receptacles (14) may be of sufficient depth and diameter to capture a ball (15) dropped from the track (11). Balls (15) used in the game may have varying diameters. Balls (15) used in the game may not fit entirely into the receptacles (14). The less likely a ball (15) may be captured in a receptacle (14) the higher the score that may be assigned to that ball or receptacle.

FIG. 2 is a top view diagram of the game board shown in FIG. 1. In addition to the features shown in FIG. 1. FIG. 2 includes one or more pivots (19, 19A) mounted on first wall (18) adjacent the apex (16) of the triangular pattern playing field (13). Pivots (19, 19A) may also act as a ball stop preventing the ball (15) from rolling off the track (11A). Pivot locations may include openings on the inside surface (26) of first wall (18). The additional pivots (19A) allow a player greater access to all the receptacles (14) available on the playing field (13). Also, by being able to change the orientation of the dual-rod track (11A), the game board (10) may be able to accommodate a variety of different playing field configurations.

FIG. 2 further comprises blocked receptacles (23). The receptacles (14) may be blocked randomly, in a desired pattern, or strategically to aid a player in achieving a desired score or other result. Since receptacles (14, 30) each have numerical and alphabetical denominations, blocked receptacles (23) may be used to prevent an opposing player from achieving a desired result, as well. For example, if most or all vowels are blocked, a player may not be able to form words or phrases. If odd numbers are blocked, certain sums could not be achieved. If the most accessible receptacles are blocked, the difficulty of the game is increased which may increase the skill level of a player required to win the game. Blocked receptacles (23) may be blocked using caps, covers, coins, tokens, cutouts, and overturned cups.

FIG. 2 further comprises receptacles (22) that are joined. A ball dropped in a joined receptacle (22) may be scored using all the numbers and letters of the respective receptacles (22) or scored using only the receptacle in which the ball finally rests. The joined receptacles (22) may comprise any number of receptacles. The joined receptacles (22) may form linear, diagonal, or cross patterns or any combination of such patterns.

An additional element on the game board (10) shown in FIG. 2 is a trough (24) for storing the various game balls (15). The game balls (15) may have different diameters adding additional variety to the game. The game balls (15) may be marbles having solid or variegated patterns and colors. Additionally, the game board (10) may comprise blocks or jacks (27) mounted on the game board as a means for elevating or tilting the game board as desired by the players. The blocks (27) may be adjustable for increasing or decreasing the tilt of the game board (10) or playing field (13). The tilt may be longitudinal or latitudinal. The tilt of the game board (13) my serve to increase or decrease the inclination of the dual-rod track (11A). Additionally, the game board (10) may slope from the center of game board (10) downward toward perimeter walls (20) and (28). The blocks (27) may increase of decrease the slope of the game board. Varying the tilt of the game board (10) may be another means for increasing or decreasing the difficulty associated with playing the game.

A tensioner (25) may be attached to the rods (11) adjacent second ends (9). The tensioner (25) may comprise an elastic band, a spring, a coil, or a piston and cylinder. By adding tension to the dual-rod track (11A), more precise manipulation of the rods may be achieved in urging the game ball (15) along the track by opening and closing the distance between the rods (11). One rod (11) may be held stationary while the other rod (11) in moved laterally as a means for moving the ball (15) along the track (11A).

FIG. 3 is a top view diagram of a substitute playing field (32) having punch-out receptacles (36) of the present invention. The playing field (32) may replace playing field (13) or it may be laid over playing field (13). Punch-out receptacles (36) are shown having a darker perimeter than the punched-out receptacles (38). The punch-out receptacles (36, 38) should have a diameter and depth sufficient to capture and hold a ball (15). The receptacles (36, 38) are shown to be hexagonal as opposed to circular receptacles (14) and additional receptacle shapes may be suitable for capturing the ball (15). The punch-out receptacles (36) may be partially cutout or perforated around the perimeter thereof to facilitate removal of the center piece. The punched-out receptacles (38) may be randomly spaced around the playing field (32)

or may be arranged in columns and rows or any other pattern according to the desires of the players. The playing field (32) may cover the entire top surface or a portion thereof of game board (10) within walls (18, 20, 21, and 28). The punched-out receptacles (38) may be blocked like receptacles (23) in FIG. 2.

Figure 4:
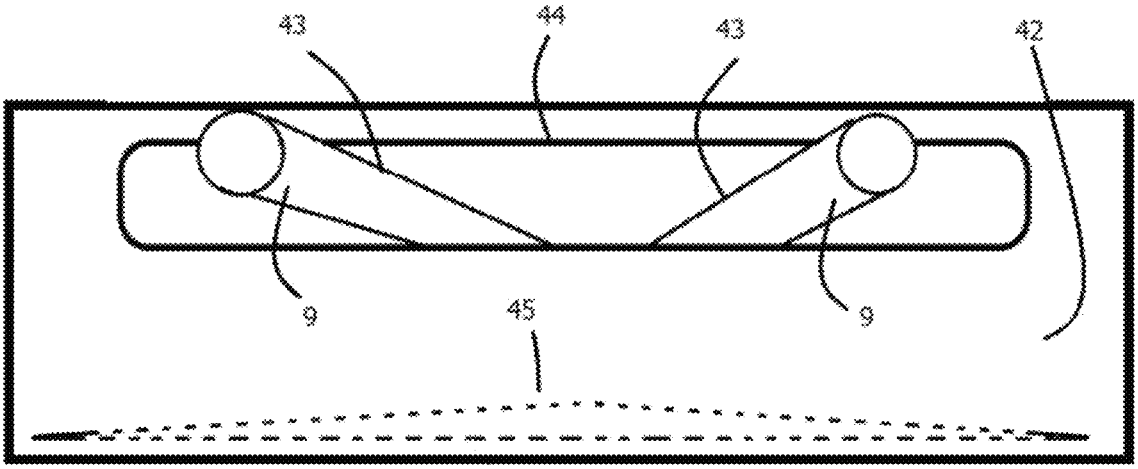
FIG. 4 is a diagram of a wall comprising an elongate slot with the dual-rod track extending from the slot of the present invention.

FIG. 4 is a diagram of the exterior of second wall (42) comprising an elongate slot (44) with the second ends (9) of rods (11) of dual-rod track (43) extending through and beyond the slot (44) of the present invention. The second wall (42) may be similar to the second wall (21) shown in FIG. 1. Alternatively, the dual-rod track (43) may be mounted on top of second wall (42) instead of passing through elongate slot (44). As described in FIG. 1 at (12), the second ends (9) of the dual-rod track (43) may comprise handles (not shown in FIG. 4.) to aid in the manipulation of the dual-rod track (43). Although the rods of the dual-rod track (43) are shown widely separated, the actual distance between the respective rods (11) may vary as the game ball (15) is urged along the track. The distance between the rods (11) at the pivot (19) may be fairly constant allowing the game ball (15) to be placed thereon, the pivot (19) also acting as a ball stop preventing the ball (15) from rolling off the track (11A). As the game ball (15) advances along the dual-rod track (43) the distance between the respective rods (11) may be reduced until the game ball (15) arrives at the desired location above the playing field (13). The elongate slot (44) may have means for controlling the distance between the rods. For example, the elongate slot (44) may comprise serrations along its lower edge that would assist in steadying the separation of the respective rods (11). Also, marks or gradations may be placed along the edge of the slot (44) to identify preferred positions of the respective rods (11). A friction reducing material may be placed on all or a portion of slot (44) where it most likely contacts the rods (11). The friction reducing material may aid in the smooth manipulation of the dual-rod track (11A, 43) and may reduce wear on the contact surfaces of the track and the slot. The friction reducing material may be placed on the rods (11) where the rods contact the surfaces of slot (44).

An interior side of second wall (21, 42) may be adjacent game board (10) as shown in FIG. 1, 2. Game board (10) may comprise a surface (45) tapered outwardly downward from the center of game board (10) toward perimeter walls (20, 28). When playing field (13) is disposed onto the tapered surface (45) of game board (10), playing field (13), or any other alternate playing field disposed onto the tapered surface (45) of game board (10), may also comprise the tapered surface (45).

Figure 5:
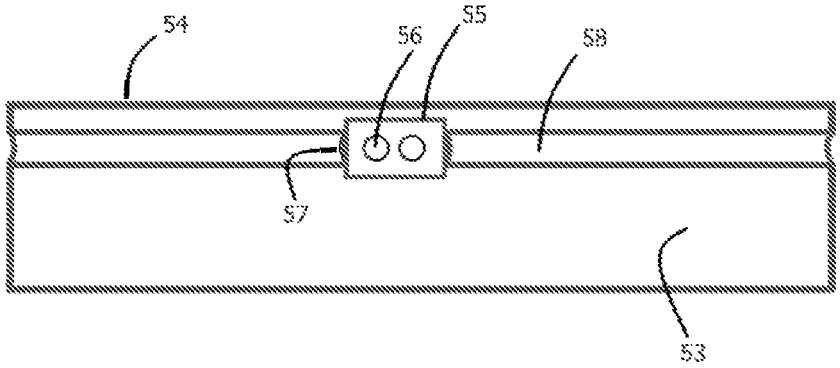
FIG. 5 is a diagram of a wall comprising a channel comprising a pivot and slider or carrier of the present invention.

FIG. 5 is a diagram of first wall (54), which may be similar to the first wall (18) of FIG. 1, comprising a channel (58) disposed on the inside surface (26, 53) in which a pivot (55) comprising a slider or carrier (57) is disposed of the present invention. The pivot (55) comprises openings (56) into which the first ends (8) of rods (11) of the dual-rod track (11A, 43) may be inserted. The slider (57) and the channel (58) may comprise friction reducing material to facilitate the smooth operation of the pivot (55) as it travels back and forth along channel (58) and to reduce wear on the contact surfaces between the slider (57) and the channel (58). The channel (58) and the slider or carrier (57) may allow the dual-rod track (11A, 43) to swing laterally and be positioned over a wider variety of receptacles that may be available in different playing field (13, 32) configurations.

Figure 6A:
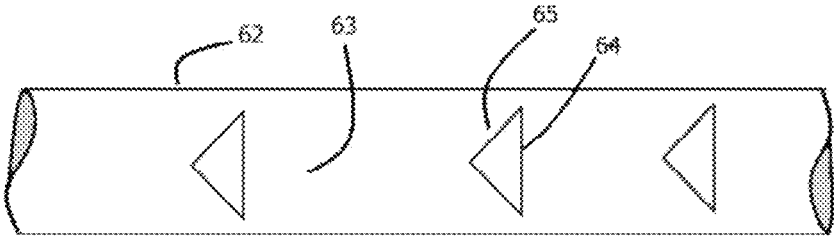
FIG. 6A is a diagram of a rod segment comprising detents of the present invention.

FIG. 6A is a top view diagram of a rod (11) segment (62) comprising detents (64) spaced along an interrupted side (63) of rod (11) segment (62) of the present invention. The rod segment (62) comprises detents (64). The one or more detents (64) may be spaced apart along the entire length of rods (11). Only the segment (62) is shown in FIG. 6A for clarity. The detents (64) may be disposed on an interrupted side (63) of rods (11). The detents (64) may be triangular shaped (65) having proportions to capture balls (15) as they travel along the dual-rod track (11A, 43) of the present invention. Detents (64) may have different shape characteristics such as depressions, undulations, hollows, protrusions, and ridges. Rods (11) may rotate within pivots (19, 19A, and 55) in such a manner to intermittently expose detents (64) to balls (15) traveling along the dual-rod track (11A, 43).

Figure 6B:
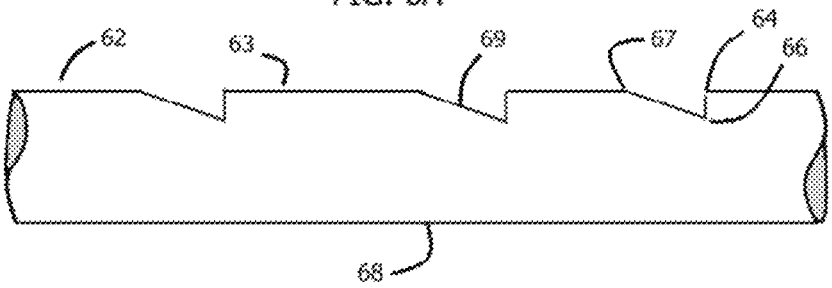
FIG. 6B is a diagram of a side view of a rod segment comprising detents of the present invention.

FIG. 6B is a side view diagram of rod segment (62) comprising one or more detents (64) disposed on the interrupted side (63) of rods (11) of the present invention. Uninterrupted side (68) of rods (11) is opposite interrupted side (63). Rods (11) may be rotated to expose only the uninterrupted sides (68) of rods (11) to the balls (15). Normally balls (15) travel between rods (11) on the uninterrupted sides (68) of the rods. If a player desires to capture or detain ball (15) as it travels along the dual-rod track (11A, 43), one or both rods (11) may be rotated to expose one or more detents (64) to the ball (15). Once ball (15) is detained, the dual-rod track (11A) may be swung laterally over a target receptacle (14, 22, and 30) and dropped into the target receptacle. Detents (64) may comprise a shoulder (64), a depth (66), a ramp (69), and transition (67) between the ramp (69) and interrupted side (63). The respective proportions of the shoulder (64), depth (66) and transition (67) of detents (64) may vary according to the size of the ball (15) being used in the game.

Figure 7:
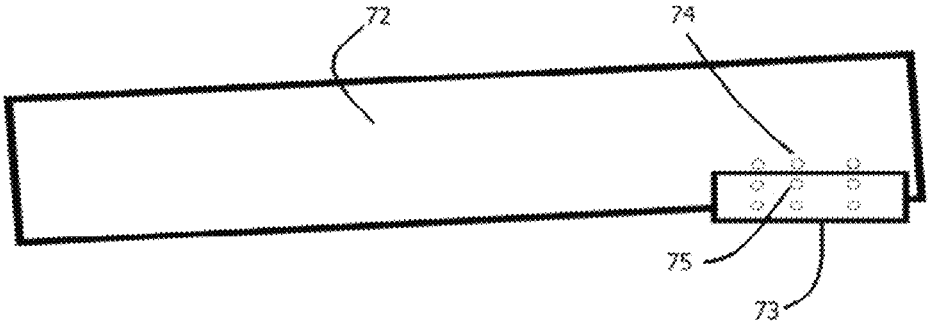
FIG. 7 is a diagram of a wall comprising an elevation block of the present invention.

FIG. 7 is a diagram of perimeter wall (72) which may be similar to perimeter walls (20, 28) as shown in FIG. 2, comprising elevation blocks (27, 73) of the present invention. The elevation blocks (27, 73) may be disposed on perimeter wall (20, 28) adjacent perimeter wall (21). Elevation blocks (27, 73) comprise openings (75) that may be spaced to align with openings (74) in perimeter walls (72, 20, and 28). The respective openings (74, 75) allow adjustment of elevation blocks (73) to increase or decrease the horizontal tilt and vertical inclination of the playing field (13). Different forms of elevation blocks may be used, such as screw jacks, lever jacks, and spacers to adjust the tilt and inclination of the playing field.

Figure 8:
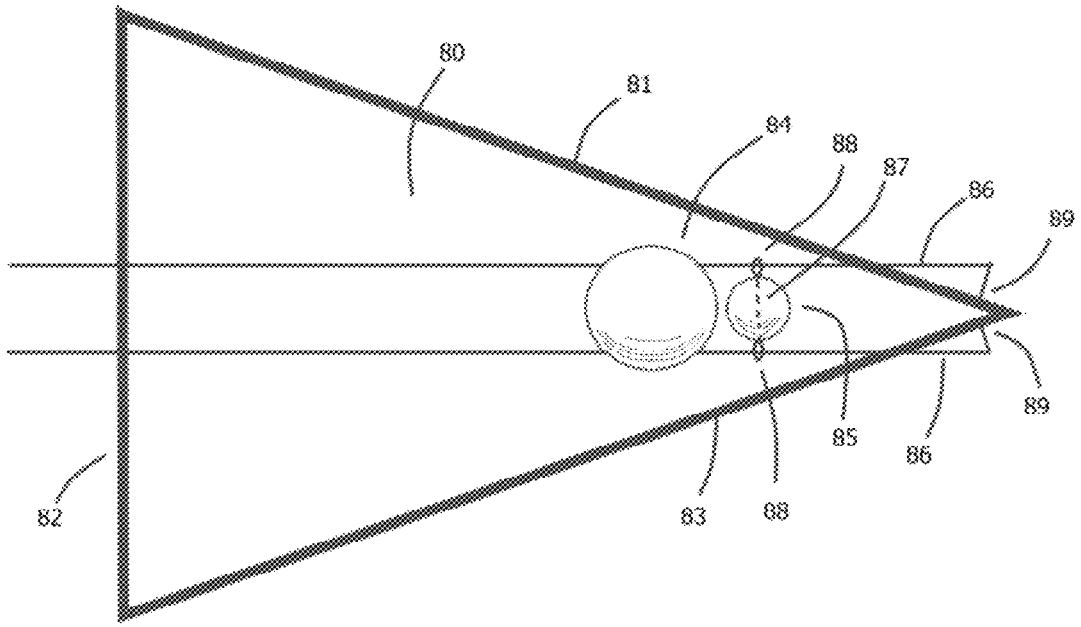
FIG. 8 is a top view diagram of a game board of the present invention comprising a slidably adjustable game ball stop.

FIG. 8 is a top view diagram of a game board of the present invention comprising a slidably adjustable game ball stop. The game board (80) may be triangular in shape and otherwise similar to game board (10), and may comprise perimeter walls (80, 81, 83) having a similar form and function of walls (18, 20, 21, 28) shown in FIG. 1. Game board (80) may comprise receptacles (not shown) comparable to receptacles (14, 23) of FIG. 2 and receptacles (36, 38) of FIG. 3. Game board (80) may comprise a dual-rod track (86) attached to perimeter walls (81, 83) at openings (89). The rods (86) are angled at openings (89) to raise the track (86) above the playing surface of game board (80). A game ball stop (85) comprising a through channel (87) having an elastic band (88) passing therethrough is mounted on the rods (86) by passing the rods (86) through elastic band loops (88) protruding from the game ball stop (85). The elastic band loops (88) may allow the game ball stop (85) to slide along rods (86) thereby controlling the distance traveled by game ball (84). The game ball stop (85) may be slidably mounted on dual-rod track (11A) of FIG. 1 and FIG. 2 to control the distance traveled by game ball (15) as previously described in those configurations. Although game ball stop (85) is shown to be spherical, game ball stop (85)

may be non-spherical, for example it may be a disk, a cube, a polyhedron, or a prism. It may be a tube or a solid rod.

Figure 9:
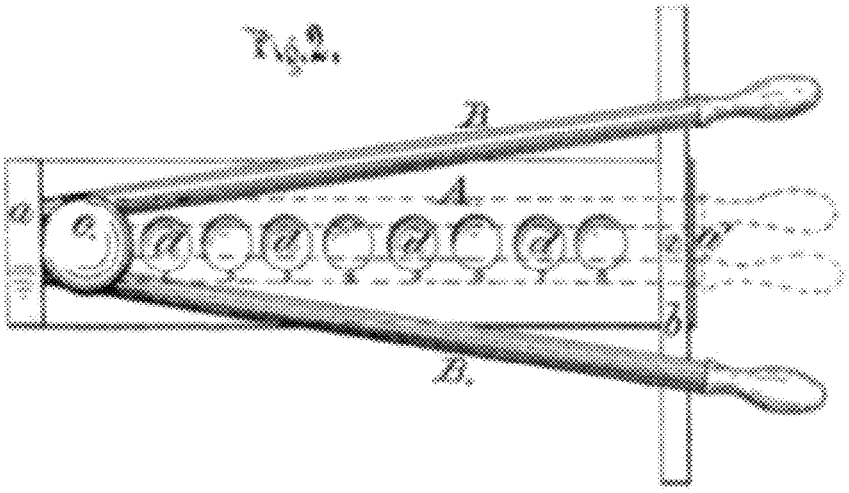
FIG. 9 is a prior art copy of FIG. 2 taken from U.S. Pat. No. 145,385, issued to Bean, R. E., Dec. 9, 1873.

FIG. 9 is a prior art copy of FIG. 2 taken from U.S. Pat. No. 145,385, issued to Bean, R. E., Dec. 9, 1873. Over the years, the basic concept and design of the prior art apparatus has not materially changed—it being the object of the Shoot the Moon game to move a ball along an inclined track comprising two rods and dropping the ball in one of the receptacles on the playing field. The reader is directed to a copy of the Bean patent available on the USPTO's website for details of the apparatus and game.

The invention claimed is:

1. A game board, comprising:

an enclosure comprising a playing surface therein tapered outwardly downward from a center thereof comprising a playing field with walls rising around a perimeter of the enclosure;

the playing field comprising open receptacles disposed randomly or in a pattern arranged in columns and rows substantially covering the playing field;

the receptacles comprising diameters and depths sufficient to capture a ball used in the game;

a laterally movable dual-rod track comprising a pair of rods comprising first and second ends disposed above the playing field at a sufficient height to pass over a captured ball on the playing field;

the rods' first ends being attached to a pivot mounted on the first wall and the second ends extending beyond the second wall, the track being inclined from the pivot to the second wall, the track swinging laterally over substantially all the receptacles on the playing field;

a game ball stop movable along the dual rod track comprising a through channel and an elastic band looped therethrough, the rods passing through the loops, and wherein when a ball is placed on the track near the the game ball stop, a player urges the ball to travel uphill along the track and dropped into one of the receptacles by manipulating the distance between the rods.

2. The game board of claim 1, wherein the playing field is removable.

3. The game board of claim 1, wherein the playing field is interchangeable with different playing fields.

4. The game board of claim 1, wherein the playing field comprises a pattern selected from a group consisting of triangles, squares, rectangles, or circles.

5. The game board of claim 1, wherein the playing field comprises one or more punch-out receptacles.

6. The game board of claim 1, wherein the receptacles comprise varying diameters and depths.

7. The game board of claim 1, further comprising multiple balls used in the game comprising varying diameters.

8. The game board of claim 1, wherein the first wall comprises two or more pivots.

9. The game board of claim 8, wherein the rods rotate within the respective openings in the respective pivots.

10. The game board of claim 1, wherein the first wall comprises an elongate channel in which a pivot comprising a slider is slidably disposed.

11. The game board of claim 1, wherein the rods comprise an uninterrupted side and an interrupted side along their respective lengths.

12. The game board of claim 11, wherein the interrupted side of the rods comprises one or more detents spaced along the length of the respective rods.

13. The game board of claim 11, wherein when the respective rods are rotated, the respective detents face one another for detaining the ball as it travels along the track.

14. The game board of claim 11, wherein when one rod is rotated, the respective detents face the uninterrupted side of the opposite rod for detaining the ball as it travels along the track.

15. The game board of claim 1, wherein one or more receptacles are blocked.

16. The game board of claim 1, wherein two or more receptacles are joined.

17. The game board of claim 1, wherein the game ball stop slidably attached to the dual-rod track comprises a sphere, a disk, a cube, a polyhedron, a prism, a tube, or a solid rod.

18. The game board of claim 1, wherein one or more receptacles comprise one or more letters and numerals appearing in or around the respective receptacles.

19. The game board of claim 1, further comprising jacks mounted adjacent to the second wall to tilt and incline the playing field.

20. The game board of claim 1, wherein a tensioner is attached to the respective rods selected from the group consisting of elastics, springs, coils, or pistons and cylinders.

* * * * *